US007980330B1

(12) United States Patent
LeJeune

(10) Patent No.: US 7,980,330 B1
(45) Date of Patent: Jul. 19, 2011

(54) WELL TUBULAR, RETRIEVABLE JOINT STRAINER AND METHOD

(76) Inventor: Robert J. LeJeune, Lafayette, LA (US)

( * ) Notice: Subject to any disclaimer, the term of this patent is extended or adjusted under 35 U.S.C. 154(b) by 336 days.

(21) Appl. No.: 12/220,181

(22) Filed: Jul. 22, 2008

(51) Int. Cl.
*E21B 43/08* (2006.01)

(52) U.S. Cl. ..... 175/314; 166/227; 166/231; 210/448; 210/452

(58) Field of Classification Search ..... 175/314; 166/227, 231; 210/448, 452
See application file for complete search history.

(56) References Cited

U.S. PATENT DOCUMENTS

| | | | | |
|---|---|---|---|---|
| 87,775 | A | 3/1869 | Himes | |
| 1,135,809 | A | 4/1915 | Jones | |
| 1,524,471 | A | 1/1925 | Benckenstein | |
| 2,155,744 | A | 4/1939 | Westrum | |
| 2,744,579 | A * | 5/1956 | Gerhardt | 175/22 |
| 3,302,722 | A * | 2/1967 | Madeley, Sr. | 166/157 |
| 3,450,207 | A | 6/1969 | Hirsch | |
| 3,548,937 | A * | 12/1970 | Kiel | 166/232 |
| 3,937,281 | A * | 2/1976 | Harnsberger | 166/233 |
| 4,495,073 | A | 1/1985 | Beimgraben | |
| 6,598,685 | B1 * | 7/2003 | Mashburn | 175/57 |
| 7,165,633 | B2 * | 1/2007 | Hall et al. | 175/314 |
| 7,188,688 | B1 * | 3/2007 | LeJeune | 175/312 |
| 7,243,742 | B2 * | 7/2007 | Kutryk | 175/314 |
| 2005/0109503 | A1 * | 5/2005 | Kutryk | 166/227 |
| 2006/0065444 | A1 * | 3/2006 | Hall et al. | 175/314 |

* cited by examiner

*Primary Examiner* — Hoang Dang
(74) *Attorney, Agent, or Firm* — Parks & Associates, P.C.

(57) ABSTRACT

A debris collector or strainer assembly for a well string tubular coupling wherein one embodiment discloses a conical coil with one end fixed to a hub, a beveled collar surrounding and supporting the hub and secured thereto with shear pins, the conical coil is deformable as necessary to capture irregular shaped objects between its coils, its loops may be closed, spaced apart, fixed or allowed to expand under pressure, and may be retrieved using an overshot fishing tool to engage a rod extending axially through the coil which may be attached at one or both ends of the coil.

9 Claims, 4 Drawing Sheets

WELL TUBULAR, RETRIEVABLE JOINT STRAINER AND METHOD

1. FIELD OF THE INVENTION

This invention relates generally to inline fluid flow screens, filters, collectors, strainers, and separators and more particularly to a debris collector for well tubular strings, one or more such collectors being conveniently locatable at a coupling joint within the string for collecting foreign or oversized matter within the fluid stream, further allowing for retrieval of the collector while down-hole.

2. GENERAL BACKGROUND

Drilling fluids are widely used for the drilling of oil and gas wells. These drilling fluids provide suppression of reservoir pressure, lubrication of the drill pipe, effect cooling of the bottom hole drill assemblies and removal of the cuttings from down-hole. Down-hole assemblies may contain individual components such as bits, stabilizers, measurement while drilling tools, etc. Often down-hole assemblies contain electronic instruments that contain microprocessors that are used to collect and/or transmit data collected by various sensor arrays to the surface for analysis to determine conditions down-hole. Drilling fluids generally contain a variety of elements, both desirable and undesirable, such as mud, chemicals, drill cuttings, metal shavings, etc. The particle size of these various elements varies from a few microns to several inches. Additionally, rig crews often inadvertently drop tools, gloves, rags, and other foreign or unwanted materials into the drilling fluid tanks, which may be pumped, unnoticed, into the well bore. In addition, down-hole broken pump and valve parts, such as rubber gaskets and metal fragments, are often circulated through the tubular string from the mud reclamation tanks through the drill string. The unwanted and/or undesirable solid materials, referred to as debris, can be extremely harmful to down-hole tools, especially those containing instruments and the like. Therefore, it is desirable to filter or otherwise collect as much of such debris as possible from the drilling fluid at the drill floor. It has been the accepted practice to install filter screens at critical locations, such as at the entrance to the mud pump, but such filter screens have often proven inadequate and provide no protection from debris that passes though the tubing from the mud reclamation tanks. Although mud screens have been inserted into the mud tanks, they have the disadvantage of being cumbersome to install and difficult to remove or to clean if necessary. In spite of the operator's best efforts, some debris still gets past the surface filtration system.

A great many methods of filtering well bore fluids have been used with varying degrees of success. One such method includes placing various types of screens in the tubular joint being added to the string prior to coupling the joint to the Kelly while the tubular members are being run into the well bore. Such devices include a cylindrical or conical screen located within the Kelly joint temporarily and removed before the next joint is applied to the string. However, in some cases, the screen is inadvertently left in the joint and allowed to advance down-hole with the joint. Some of these screens have retrieval capability while down-hole without uncoupling the joint.

Since it is quite beneficial to screen the drilling fluid being pumped down-hole through the drill string at the drill floor in a manner that is supposed to eliminate any foreign debris from becoming entrained in the fluids that may plug or damage any of the down-hole tools or sensitive instruments located therein during drilling operations, one would assume that very little debris would accumulate within the down-hole strainer/collectors. However, when the strainer is allowed to remain in the joint down-hole, flow though the drill string is reduced, thus increasing the pressure requirement. If the down-hole screen becomes even partially blocked, the flow of fluids is even further reduced, thereby, reducing the necessary fluids to the drill bit and thus increasing wear. In some cases a second strainer is placed at the Kelly joint to help prevent debris from reaching the strainer left in the joint down-hole further reducing fluid flow.

In many cases, removal of the down-hole screen can only be accomplished by tripping the pipe out of the hole which, of course, becomes impossible in the event that the pipe string is stuck. If left in place, a down-hole screen will prevent a blockage to any tools, such as survey instruments, string shots, etc., that may be run any time during the drilling operation. Of course, fluid pressure through the drill string will increase due to resistance and the screen may eventually become plugged and severely limit the flow of fluid unless it is removed and cleaned occasionally. Down-hole type screens heretofore provided, although capable of removal, run an extreme risk that the debris collected by the screen will escape from the screen during the removal process and then plug the down-hole devices meant to be protected in the first place. Therefore, there is a need for a tool joint filtering device, which efficiently filters the drilling fluid while still allowing maximum flow-through capabilities. It is far better to retrieve a tool that has become inoperative due to a plugged filter than due to extreme damage by such debris.

In addition, since the down-hole drilling fluids are quite abrasive and are pumped at high pressures of approximately 5000 PSI, any reductions in filter slot size increases velocity. Therefore, filters and strainer disks having such slots suffer significant wear and breakage when subjected to such high pressure. It becomes obvious that in cases where high velocity is not required, slot size should be maximized and that more attention should be paid to the type of metal, surface preparation, and cladding to reduce abrasion wear.

3. SUMMARY OF THE INVENTION

A debris collector or strainer for well string tubular coupling that is capable of being located at any coupling within a tubing string, the purpose of which is to collect foreign or oversized matter within the fluid stream passing through a drill string. Principally such debris collector or strainer is located between the Kelly and the uppermost tubular joint. In practice, however, only one such collector is used in drill strings preferably located at the Kelly joint or the upper most tool joint in the drill string. The collector is removed prior to coupling the next successive joint and again placed in the Kelly joint of the next tubular joint, thereby not allowing the collector or screen to purposely pass down-hole. In the event that the collector is inadvertently disposed down-hole, a retrieval element attached to the collector is provided for mating with an over-shot fishing tool to retrieve the collector.

An embodiment discloses a conical coil with one end fixed to a hub, a beveled collar surrounding and supporting the hub and secured thereto with shear pins. The conical coil is deformable as necessary to capture irregular shaped objects between its coils. The coil loops may be closed, spaced apart, fixed, adjusted to admit a desired particle size or allowed to expand under pressure. A retrieval rod, for use with an overshot fishing tool, extends axially through the coil and is fixed or adjustably attached at one or both ends of the coil.

4. BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein.

5. DETAILED DESCRIPTION OF THE PREFERRED EMBODIMENT

Figure 1:
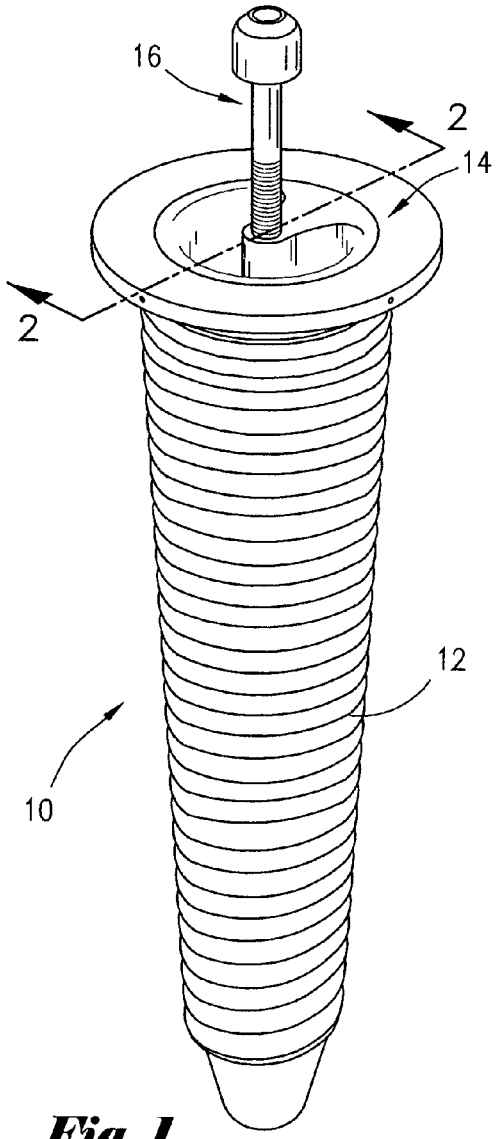
FIG. 1 is an isometric view of the conical collector assembly.

The collector or strainer assembly 10, shown in FIG. 1, includes an elongated, conical-shaped, wire spring coil 12 having a plurality of loops and fixed at one end to a hub and collar assembly 14. A retrieval assembly 16 is threadably attached to an internally threaded portion 17 of the hub member 18 better seen in FIG. 3 the threaded portion extending axially the hub member. An adjustment stem or compression rod 11 is also threadably attached to the threaded portion 17 of the hub member 18 and extends axially through the coil 12 to the distal end and threadably attached to a conical nut 15. The rod 24, seen in FIG. 3, extends above the hub and collar assembly 14 at the proximate end of the strainer assembly 10.

Figure 2:
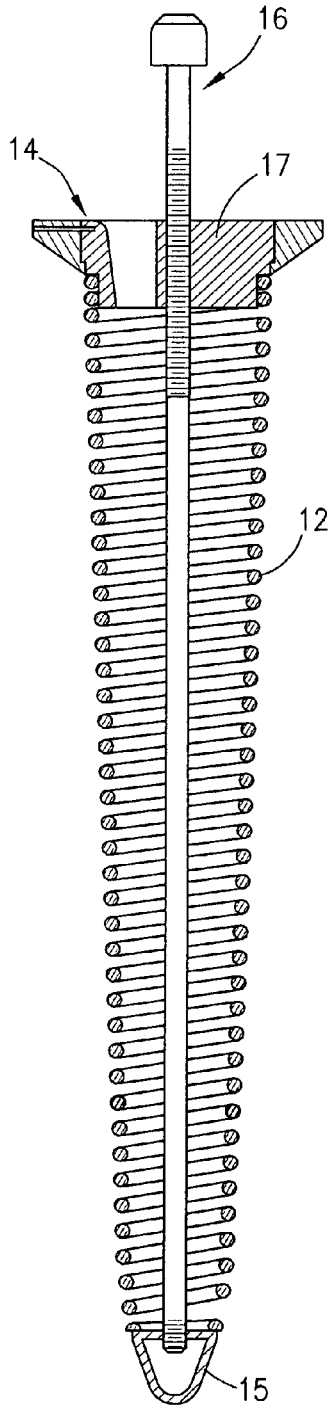
FIG. 2 is a vertical section view of the conical collector assembly taken along site line 2-2.

As further shown in cross-section in FIG. 2, the coil 12 is considered expanded when each loop of the coil is spaced apart. The spacing may be determined by the fluid flow requirements passing through the tubing string and or the pressure being exerted on the collector 10. The spacing between each loop of the coil may be uniformly adjusted as desired in the field by simply rotating the conical nut 15. However, in some cases, the coil's loops may be closed or considered compressed as well eliminating the compression rod 11 and nut 15 allows fluid flow pressures to open the coil's loops.

Figure 3:
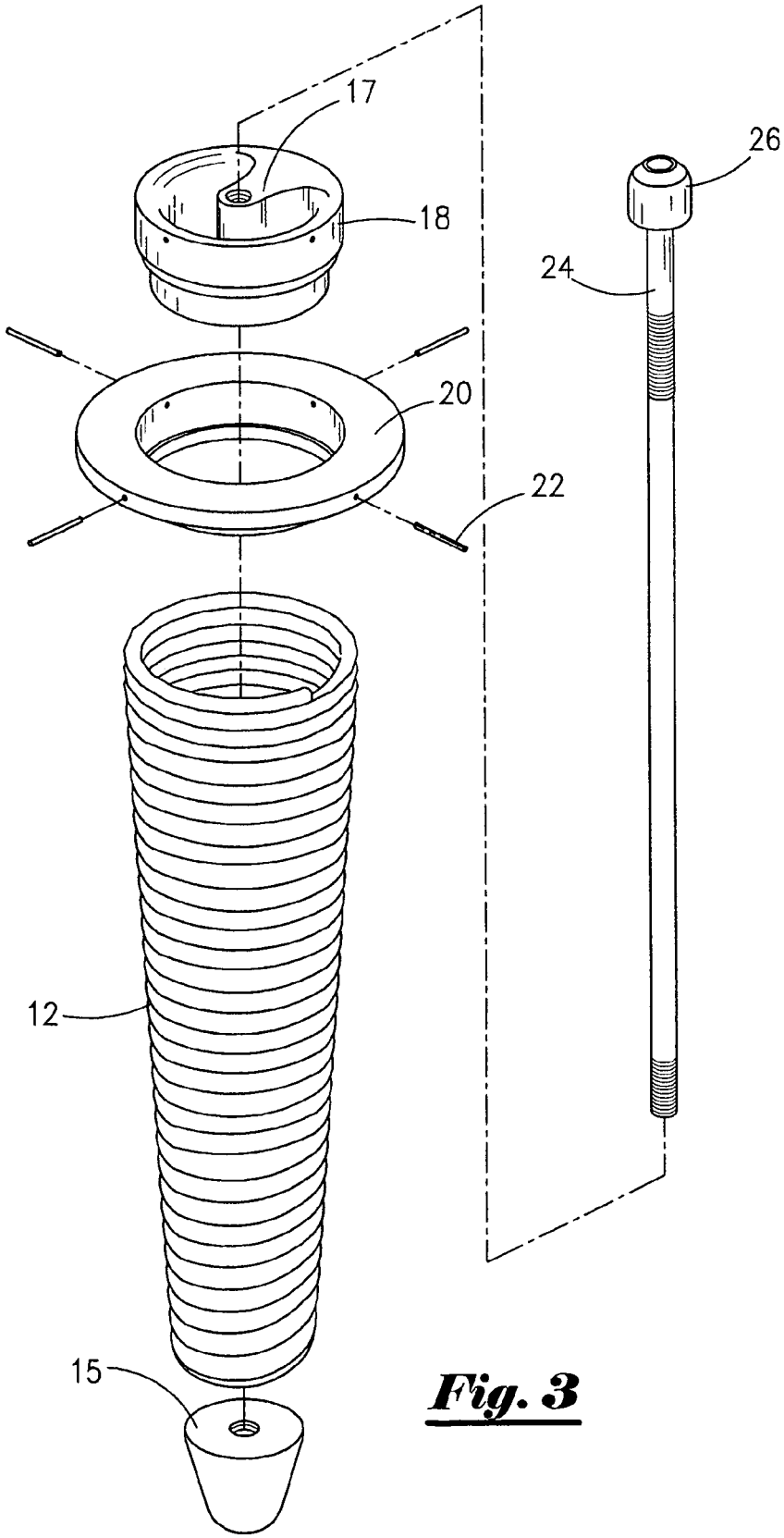
FIG. 3 is an exploded view of the conical collector assembly.

As seen in the exploded view of FIG. 3, the collar assembly 14 includes a hub member 18 to which is fixed the open proximate end of the conical coil 12 and a beveled collar 20 surrounding the hub member 18 and retained thereto with a plurality of shear pins 22. However, other methods of retention may be utilized that allow separation of the hub and collar assembly 14, such as an interference fit or adhesives, etc. The retrieval assembly 16 includes a central rod 24 attached to the washer 15 and fitted with a knob 26 at one end and a brace member 17. The rod 24 may be connected only to the lower end of the coil, thus allowing irregular debris to deform the coil and or allow fluid pressure to force the coil's loops apart to insure adequate flow, or the rod 24 may also be attached to the hub 18, thereby fixing the spacing between the coil's loops. A predetermined spacing between the loops may be set to insure a specific fluid flow rate through the collector assembly 10.

Figure 4:
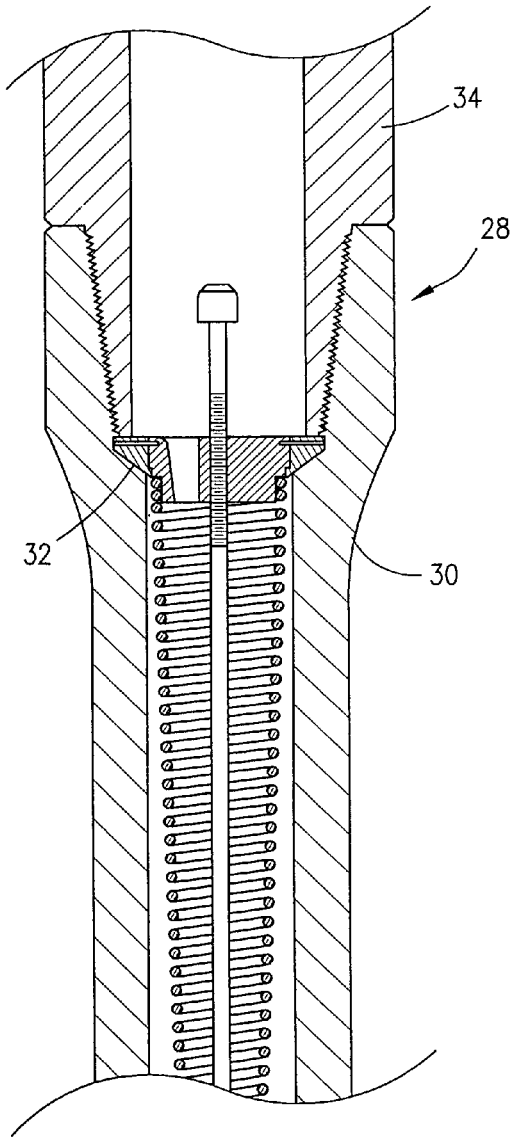
FIG. 4 is a vertical cross-section view of the conical collector assembly installed within a well tubular coupling.

In application, the collector assembly 10 is installed as a loose fit within a coupling assembly 28, as shown in FIG. 4, with the beveled collar 20 in a cooperative fit with the beveled seat 30 located within the box-end portion 32 of the coupling 28 and captured therein by the pin end 34 of the coupling 28 (generally the Kelly member of a drill string).

Figure 5:
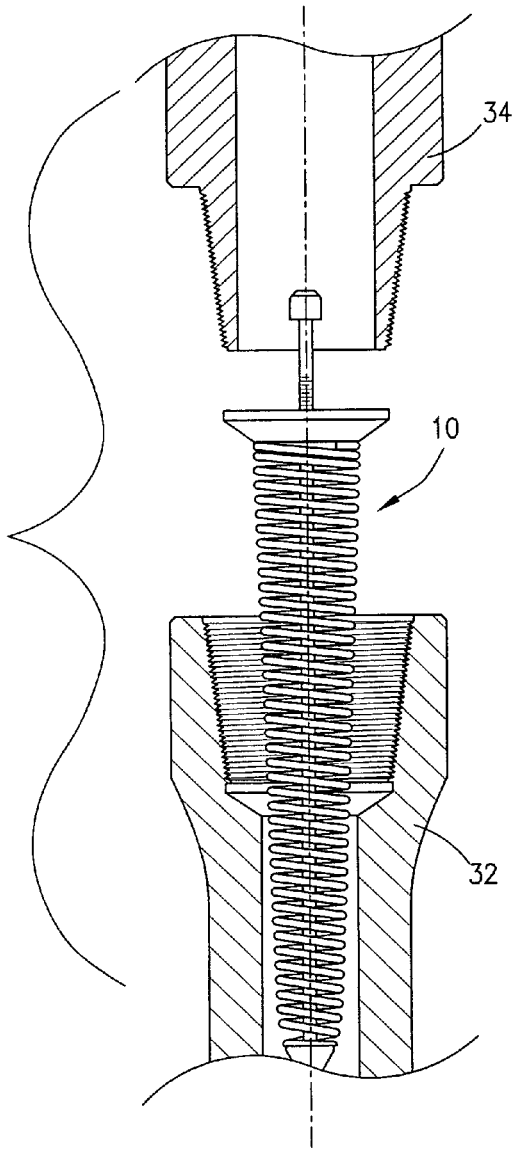
FIG. 5 is a vertical cross-section view of the pin end and box-end tubular elements of a well tubular string with the conical collector assembly being installed at joint make-up.

As shown in FIG. 5, the coil assembly 10 is simply inserted within the box-end 32 of the tubular coupling 28. Each coupling 28 is made-up of tubular joints, each having a pin end 34 at one end and a box end 32 at the opposite end. The pin end 34 of a subsequent tubular joint, usually the Kelly (driving member for the tubular drill string), is then threadably coupled to the box end 32, thereby making up the joint. As the tubular drill string is fed into the well bore, the Kelly is disconnected and the collector coil assembly 10 is manually removed and inserted into the box-end of the next tubular joint prior to its coupling to the pin end 34 of the Kelly.

Figure 6:
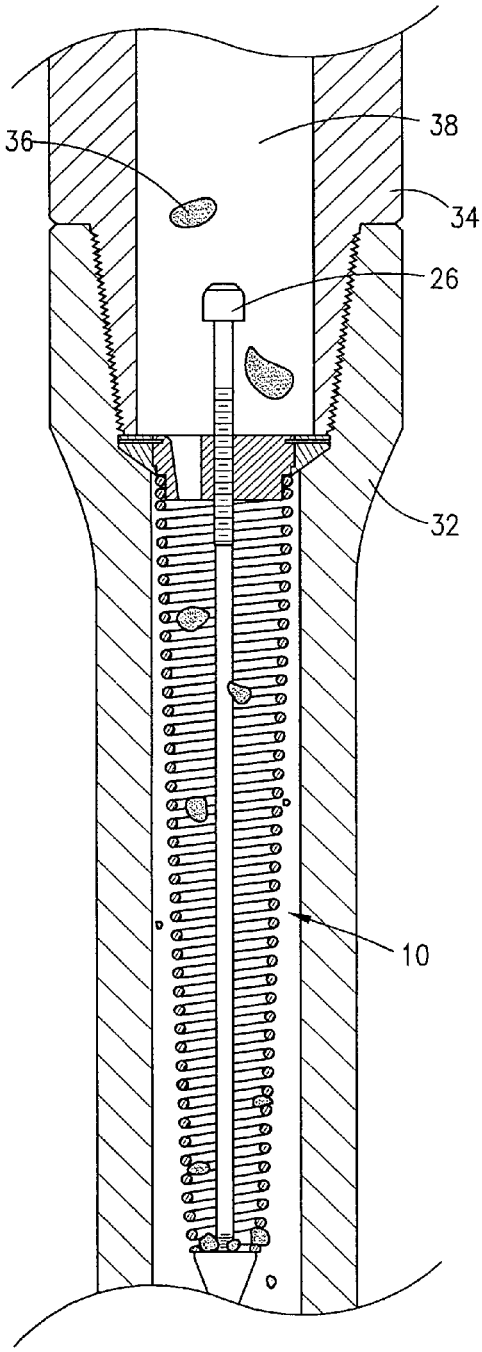
FIG. 6 is a vertical cross-section view of conical collector and debris being collected.

As shown in FIG. 6, debris 36 entrained in drilling fluids and mud flowing through the annulus 38 of the drill string passing through the coupling 28 where the conical spring collector assembly 10 is located, which are of a size that may block flow or otherwise damage downstream tools, are collected as shown within and between the collator's loops. The conical coil assembly 10 reduces backpressure, friction and wear while permitting sufficient flow through the coupling 28.

Figure 7:
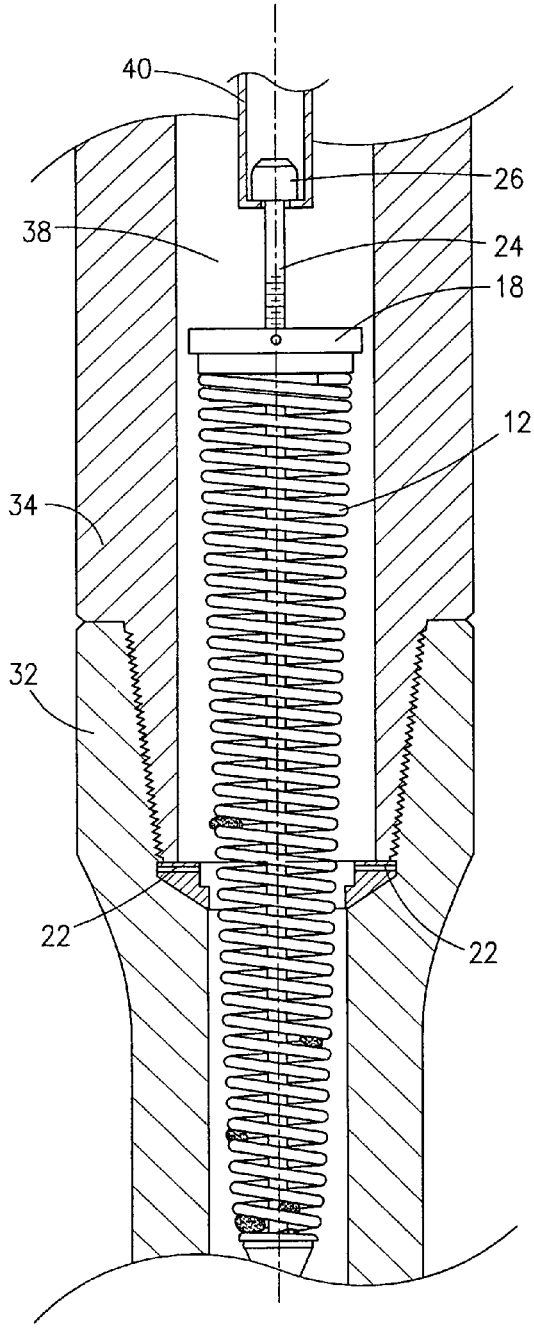
FIG. 7 is a vertical cross-section view of the conical collector being extracted from the tubular using an overshot tool.

As shown in FIG. 7, the coil 12 and its hub member 18 may be separated and removed from the annulus by engaging the knob 26 with an overshot fishing tool 40 and applying upward force, thereby shearing the shear pins 22 in a manner common within the art.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

What is claimed is:

1. A down-hole tubular joint strainer assembly comprising:

a. a conical shaped compressed wire coil having a plurality of spiraling loops;

b. a hub attached to one end of said coil;

c. a collar located adjacent said hub;

d. a shear means connecting said collar to said hub; and e. a retrieval rod having a knob at one end extending upwards from a threaded portion of said hub and located along the longitudinal axis of said strainer assembly.

2. The down-hole tubular joint strainer assembly according to claim 1 further comprises a compression rod member extending from said threaded portion of said hub extending axially through said coil.

3. The down-hole tubular joint strainer assembly according to claim 2 further comprises a conical nut threadably attached to end of said compression rod whereby rotation of said nut establishes a predetermined spacing between of said coil.

4. The down-hole tubular joint strainer assembly according to claim 1 wherein said coil is flexible.

5. The down-hole tubular joint strainer assembly according to claim 1 wherein said coil is expandable under pressure.

6. The down-hole tubular joint strainer assembly according to claim 1 wherein said coil is deformable.

7. A down-hole tubular joint strainer assembly comprising:

a. an extended conical shaped wire coil having a plurality of spiraling loops;

b. a hub having a threaded central portion attached to one end of said coil;

c. a collar located adjacent said hub;

d. a shear means connecting said collar to said hub;

e. a retrieval rod having a knob at one end located along a central longitudinal axis extending upwards from said threaded portions of said hub;

f. a compression rod threadably attached to said threaded portion of said hub extending longitudinally through said coil; and g. a nut attached to an end of said second rod for compressing said coil to a desired spacing between said loops.

8. The down-hole tubular joint strainer assembly according to claim 7 wherein said nut is conical shaped.

9. The down-hole tubular joint strainer assembly according to claim 8 wherein said strainer assembly is adjustable to control flow through said coil.

* * * * *